US008658955B2

(12) United States Patent
Dale

(10) Patent No.: US 8,658,955 B2
(45) Date of Patent: Feb. 25, 2014

(54) OPTICAL ASSEMBLY INCLUDING A HEAT SHIELD TO AXIALLY RESTRAIN AN ENERGY COLLECTION SYSTEM, AND METHOD

(75) Inventor: Erik T. Dale, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 165 days.

(21) Appl. No.: 13/081,841

(22) Filed: Apr. 7, 2011

(65) Prior Publication Data

US 2012/0256040 A1 Oct. 11, 2012

(51) Int. Cl.

| | |
|---|---|
| ***F41G 7/20*** | (2006.01) |
| ***F42B 15/01*** | (2006.01) |
| ***B64D 45/00*** | (2006.01) |
| *F41G 7/00* | (2006.01) |
| *F42B 15/00* | (2006.01) |

(52) U.S. Cl.
USPC ..... 244/3.16; 244/3.1; 244/3.15; 244/117 R; 244/119; 244/121

(58) Field of Classification Search
USPC ..... 244/3.1–3.19, 117 R, 119, 121, 158.1, 244/158.9, 159.1; 343/872, 873; 250/200, 250/206, 214 R, 214.1; 313/11, 37, 38
See application file for complete search history.

(56) References Cited

U.S. PATENT DOCUMENTS

| | | | | |
|---|---|---|---|---|
| 2,159,255 | A * | 5/1939 | Clark | 313/38 |
| 2,296,269 | A * | 9/1942 | Craig et al. | 250/214.1 |
| 2,443,121 | A * | 6/1948 | Smith | 313/38 |
| 3,634,863 | A * | 1/1972 | Dow | 343/873 |
| 3,680,130 | A * | 7/1972 | Jones et al. | 343/873 |
| 3,747,530 | A * | 7/1973 | Tepper | 343/872 |
| 3,762,666 | A * | 10/1973 | Thompson | 343/872 |
| 3,925,783 | A * | 12/1975 | Bleday et al. | 343/872 |
| 4,155,521 | A * | 5/1979 | Evans et al. | 244/3.16 |
| 4,173,187 | A * | 11/1979 | Steverding | 343/872 |
| 4,323,012 | A * | 4/1982 | Driver, Jr. | 244/121 |
| 4,677,443 | A * | 6/1987 | Koetje et al. | 343/872 |
| 4,702,439 | A * | 10/1987 | Kelley et al. | 244/159.1 |
| 5,456,179 | A * | 10/1995 | Lamelot | 244/3.16 |
| 5,457,471 | A * | 10/1995 | Epperson, Jr. | 343/872 |
| 5,691,736 | A * | 11/1997 | Hunn et al. | 343/872 |
| 7,093,799 | B1 * | 8/2006 | Dulat et al. | 244/3.1 |
| 7,423,245 | B2 * | 9/2008 | Baumgart | 244/3.1 |
| 8,130,167 | B2 * | 3/2012 | Glabe et al. | 343/872 |

* cited by examiner

*Primary Examiner* — Bernarr Gregory
(74) *Attorney, Agent, or Firm* — Schwegman, Lundberg & Woessner, P.A.

(57) ABSTRACT

Some embodiments relate to an optical assembly that includes an energy collection system that collects energy and a heat shield that axially restrains the energy collection system. The optical assembly further includes a sensor and a structure which supports the energy collection system such that the energy collection system directs the energy to the sensor. Other embodiments relate to a projectile that includes a propulsion system, a guidance system and an optical assembly as described above. Other embodiments relate to a method of directing a projectile that includes collecting energy using an energy collection system; directing the energy to a sensor; axially restraining the energy collection system using a heat shield; using a guidance system to determine the position of the projectile based on data received from the sensor; and directing the projectile toward the destination using a propulsion system that is commanded by a guidance system.

27 Claims, 6 Drawing Sheets

OPTICAL ASSEMBLY INCLUDING A HEAT SHIELD TO AXIALLY RESTRAIN AN ENERGY COLLECTION SYSTEM, AND METHOD

TECHNICAL FIELD

Embodiments pertain to a heat shield, and more particularly to a heat shield that is part of an optical assembly on a projectile.

BACKGROUND

Projectiles usually include a propulsion system and a guidance system that commands the propulsion system in order to direct the projectile toward a destination. Projectiles also commonly include energy collection systems (e.g., optical systems) that collect and direct light to a sensor that provides data to the guidance system. Based on the data received from the sensor the guidance system provides appropriate commands to the propulsion system.

Conventional optical systems typically include restraining structures that limit the movement of the components within the optical assembly during the operational life of the projectile. One of the drawbacks with existing restraining structures is that they occupy a relatively large amount of valuable space within a projectile thereby limiting the amount of ordinance and/or propellant that can be put in the projectile.

Another drawback with conventional restraining structures is that they provide little or no shielding from heat and/or stray light. Historically, additional components were required in order to perform these shielding functions.

SUMMARY

Some embodiments relate to an optical assembly which includes an energy collection system and a heat shield that axially restrains the energy collection system. The optical assembly further includes a sensor and a structure which supports the energy collection system such that the energy collection system directs energy to the sensor.

In some embodiments, the heat shield is configured to provide a barrier that prevents stray energy from reaching the sensor. In addition, the heat shield may include flexures that serve to axially restrain the energy collection system.

Other embodiments relate to a projectile that includes a propulsion system and an optical assembly. The optical assembly includes an energy collection system and a heat shield that axially restrains the energy collection system. The optical assembly further includes a sensor and a structure which supports the energy collection system such that the energy collection system directs energy to the sensor. The projectile further includes a guidance system that receives data from the sensor in order to direct the propulsion system.

The projectile may further include a shim that is positioned between the support and the heat shield in the optical assembly. As an example, the shim may be a disc that surrounds the structure which supports the energy collection system.

Still other embodiments relate to a method of directing a projectile. The method includes collecting energy using an energy collection system and directing the energy to a sensor using the energy collection system. The method further includes (i) axially restraining the energy collection system using a heat shield; (ii) using a guidance system to determine the position of the projectile relative to a destination based on data received from the sensor; and (iii) directing the projectile toward the destination using a propulsion system that is commanded by the guidance system.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

As used herein, projectile refers to missiles, guided projectiles, unguided projectiles, gliders, manned and unmanned air vehicles and sub-munitions.

Figure 1:
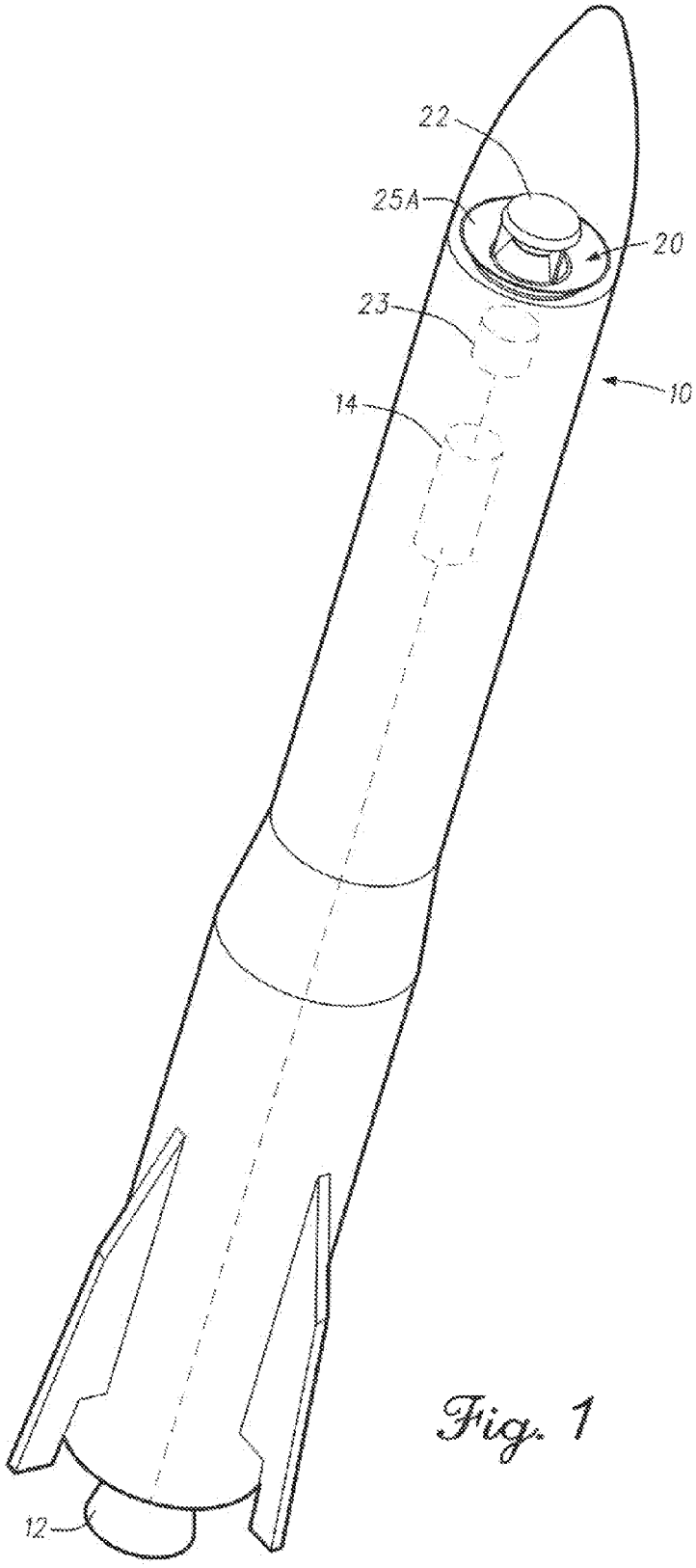
FIG. 1 is a perspective view illustrating a projectile in accordance with an example embodiment.
Figure 2:
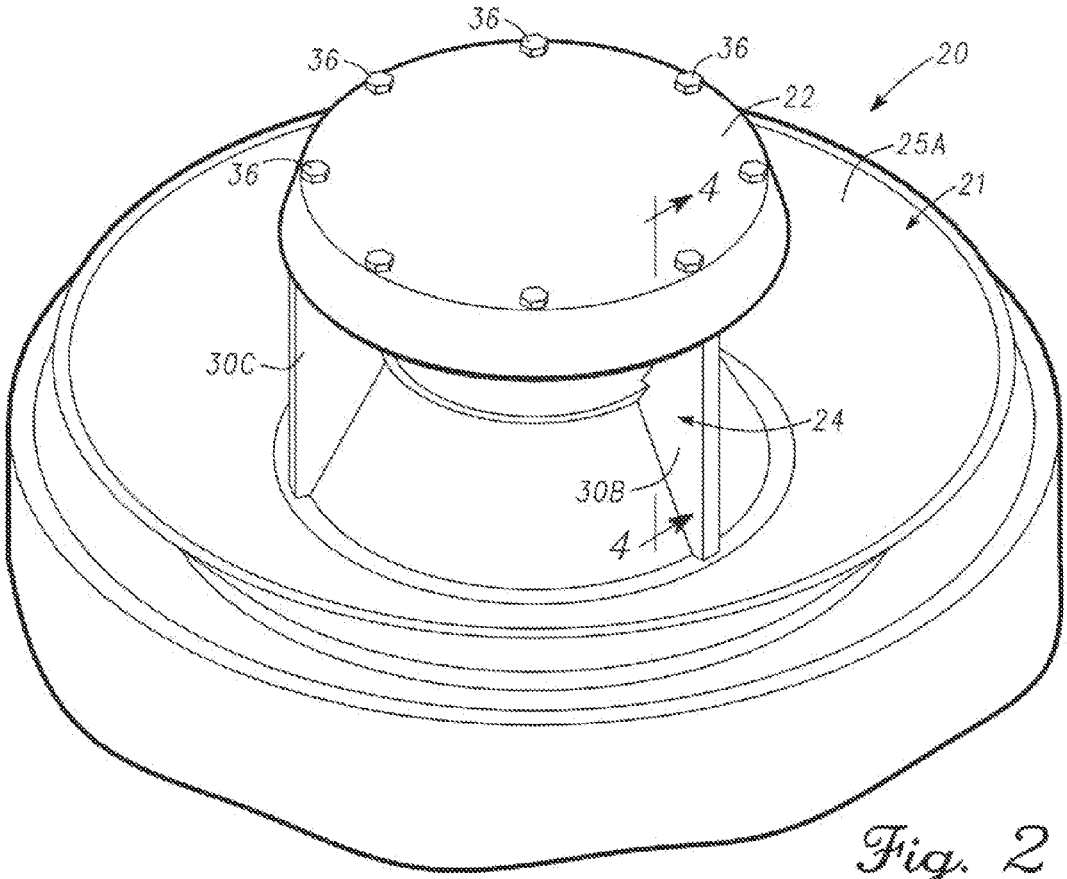
FIG. 2 is a perspective view of an example optical assembly that may be used in the projectile shown in FIG. 1.

FIG. 1 illustrates an example projectile 10. The projectile 10 includes a propulsion system 12 that maneuvers the projectile 10 toward a destination (e.g., a target). The type of propulsion system 12 that is utilized in the projectile 10 will depend in part on (i) the application in which the projectile 10 is being used; (ii) the overall size and shape of the projectile 10; (iii) the type and amount of payload being carried by the projectile 10; (iv) the overall size and shape of the canister where the projectile 10 is stored; and/or (v) the range to the target where the projectile 10 is being delivered.

Figure 4:
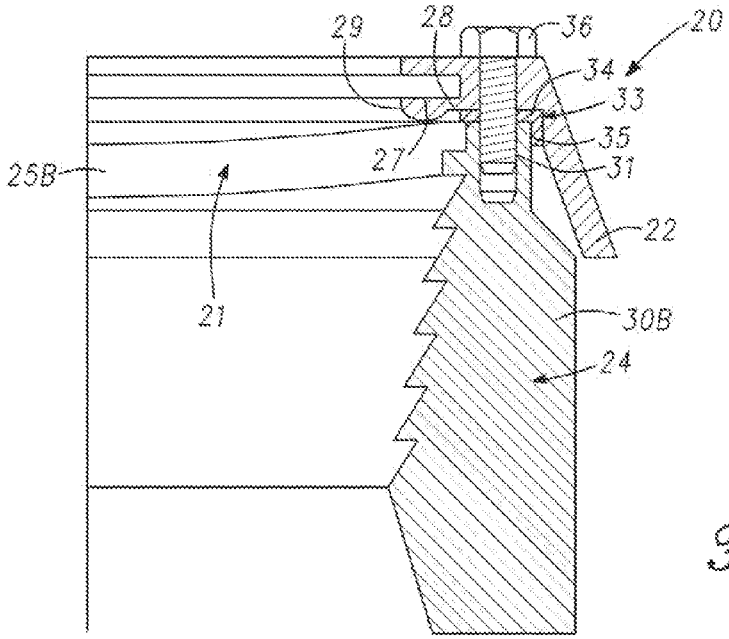
FIG. 4 is a section view illustrating a portion of the example optical assembly shown in FIG. 2 taken along line 4-4.
Figure 5:
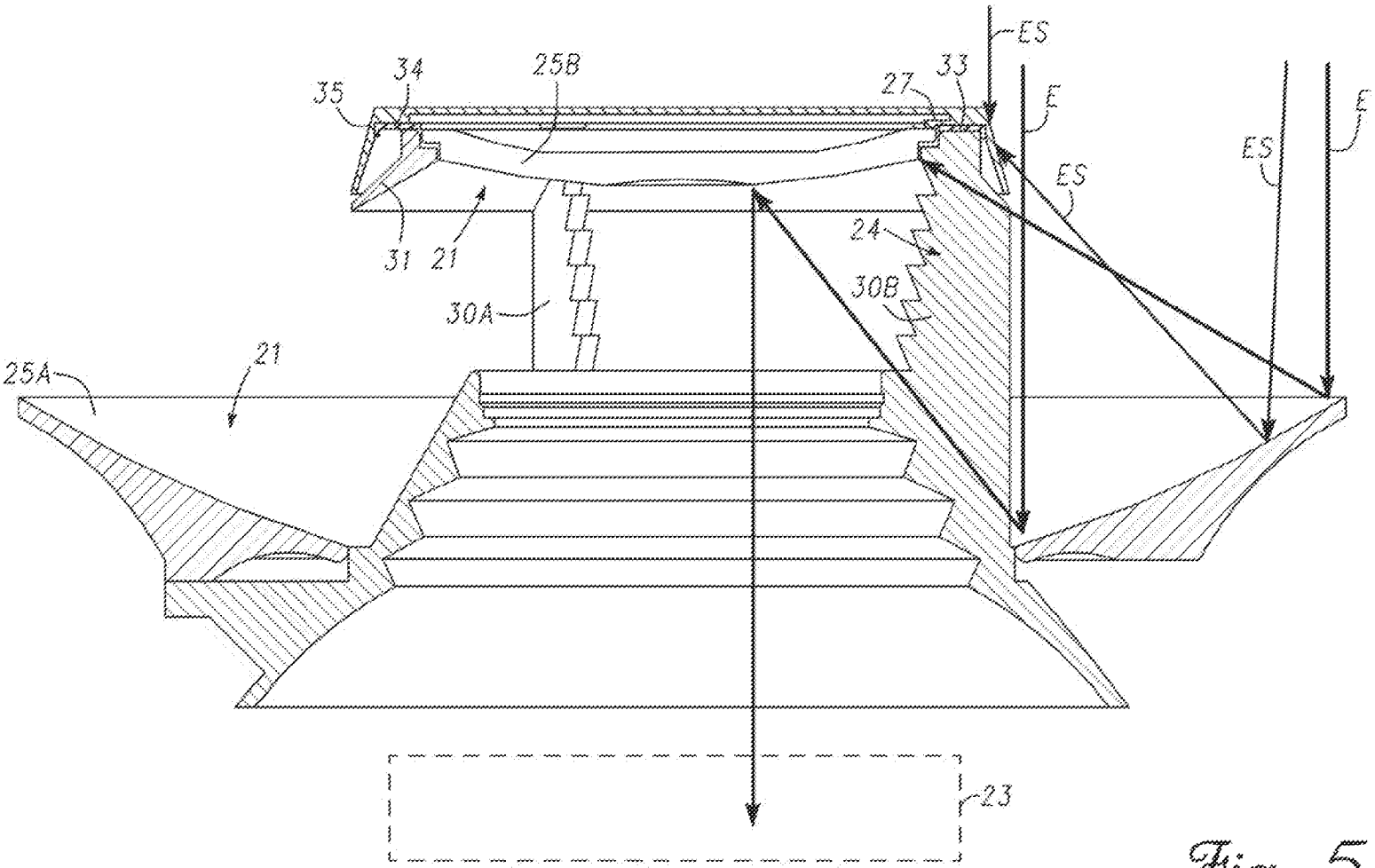
FIG. 5 is a section view taken through the longitudinal axis of the example optical assembly shown in FIGS. 2-4.

The projectile 10 further includes optical assembly 20 (shown more clearly in FIGS. 2-6) which has an energy collection system 21 that collects energy E (see, e.g., FIG. 5). In some embodiments, the energy collection system 21 collects visible light. It should be noted that the energy collection system 21 may collect a variety of different types of energy (e.g., thermal energy or radiation), as well as light that ranges across a broader spectrum than just visible light (e.g., ultraviolet and infrared light).

The optical assembly 20 further includes a heat shield 22 that axially restrains the energy collection system 21. In some embodiments, the heat shield 22 is made of 6AL 4V titanium, which has low thermal conductivity with respect to other types of metals.

The optical assembly 20 further includes a sensor 23 (shown in FIGS. 1 and 5), and a structure 24 that supports the energy collection system 21 such that the energy collection system 21 directs energy to the sensor 23. In some embodiments, the sensor 23 may be a radio frequency, infrared, visible light, thermal sensor or any other type of electromagnetic energy detecting device. The type of sensor 23 that is included in the projectile 10 will depend in part on (i) the application in which the projectile 10 is being used; (ii) the overall size and shape of the projectile 10; (iii) the type of target where the projectile 10 is being directed; and/or (iv) the type and amount of payload being carried by the projectile 10 (among other factors).

In the illustrated example embodiment, the energy collection system 21 includes a first mirror 25A that directs energy E to a second mirror 25B (see FIG. 5). The second mirror 25B receives the energy E from the first mirror 25A and further directs the energy E to the sensor 23. It should be noted that the size, shape and arrangement of the first mirror 25A and the second mirror 25B may vary depending on (i) the application where the projectile 10 is being used; (ii) the overall size and shape of the projectile 10; and/or (iii) the type of energy that is being collected by the energy collection system 21 (among other factors).

As shown most clearly in FIG. 5, the heat shield 22 may be configured to provide a barrier that prevents stray energy ES from reaching the sensor 23. The overall configuration of the heat shield 22 will depend in part on the design of the first mirror 25A and the second mirror 25B.

Reducing the amount of stray energy E (e.g., light) that enters the sensor 23 may allow the projectile 10 to be more accurately directed toward a target. Example sources of stray energy ES include scatter by objects other than the target in the field of view or energy from the sun.

Figure 6:
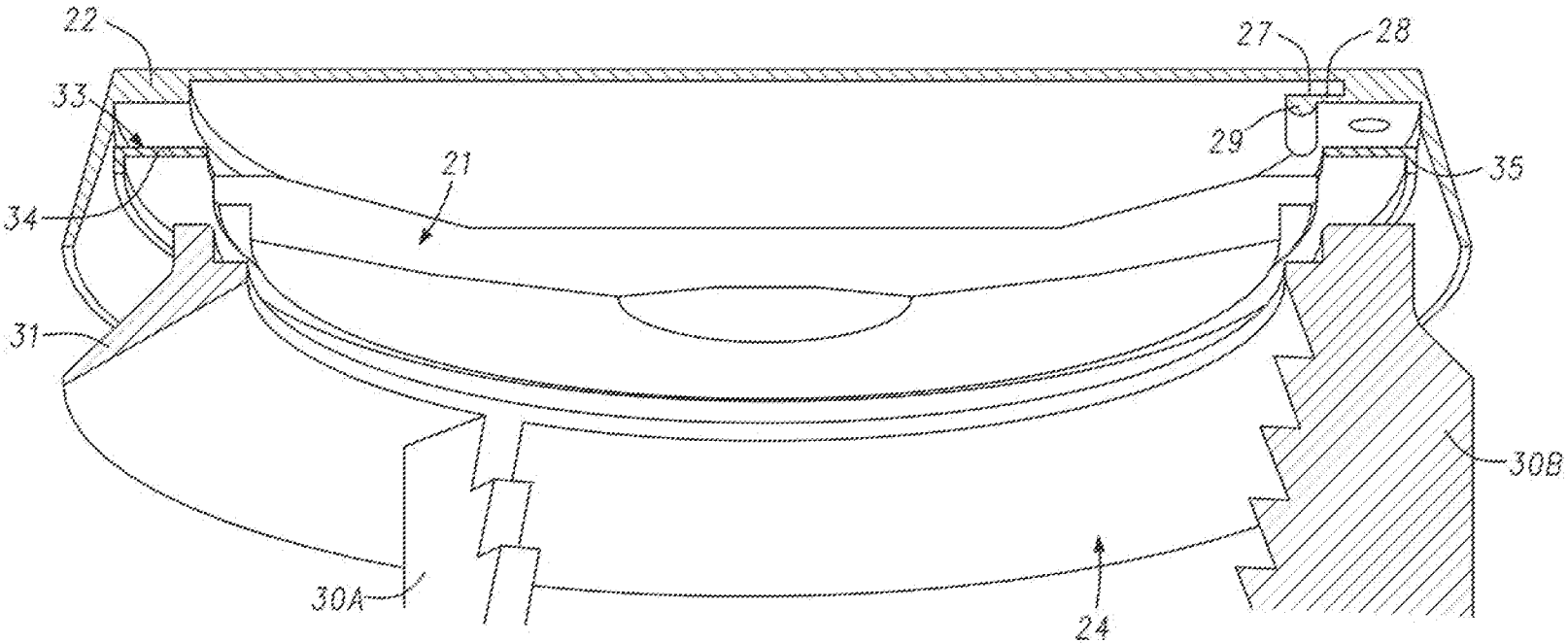
FIG. 6 is an exploded perspective view of the example optical assembly shown in FIGS. 2-5 where the view is also a section view through the longitudinal axis of the optical assembly.

In some embodiments, the heat shield 22 includes flexures 27 that axially restrain the energy collection system 21. FIGS. 4-6 show example embodiments where the flexures 27 are formed in part as cantilevered beams 28 which include a projection 29 that engages the second mirror 25B.

As an example, the cantilevered beams 28 may be 0.003 inches thick. The shape of the flexures 27 interface the second mirror 25B as a line of contact (or even a point of contact) above different portions of the structure 24 that is used to support the second mirror 25B so as to minimize any distortion of the second mirror 25B (or some other form of optic in other embodiments). In addition, the flexures 27 may provide a more consistent axial load on the second mirror 25B as temperatures change during operation of the projectile 10

As shown most clearly in FIGS. 4-6, the heat shield 22 may surround the structure 24 such that the flexures 27 may be positioned at equal intervals around the heat shield 22. In the example embodiment that is illustrated in the FIGS., the structure 24 is formed of three braces 30A, 30B, 30C that extend upward from a body of the projectile 10. The three braces 30A, 30B, 30C are positioned at 120 degree intervals around the longitudinal axis of the projectile 10.

Embodiments are contemplated that include more or less than three braces 30A, 30B, 30C. The size, number and shape of any braces 30A, 30B, 30C that are used to support the second mirror 25B will depend in part on (i) the type of energy collection system 21 that is used in the in the projectile 10; (ii) the overall configuration of the rest of the projectile 10; and/or (iii) the strength and type of material that is used to form the braces 30A, 30B, 30C (among other factors).

Figure 3:
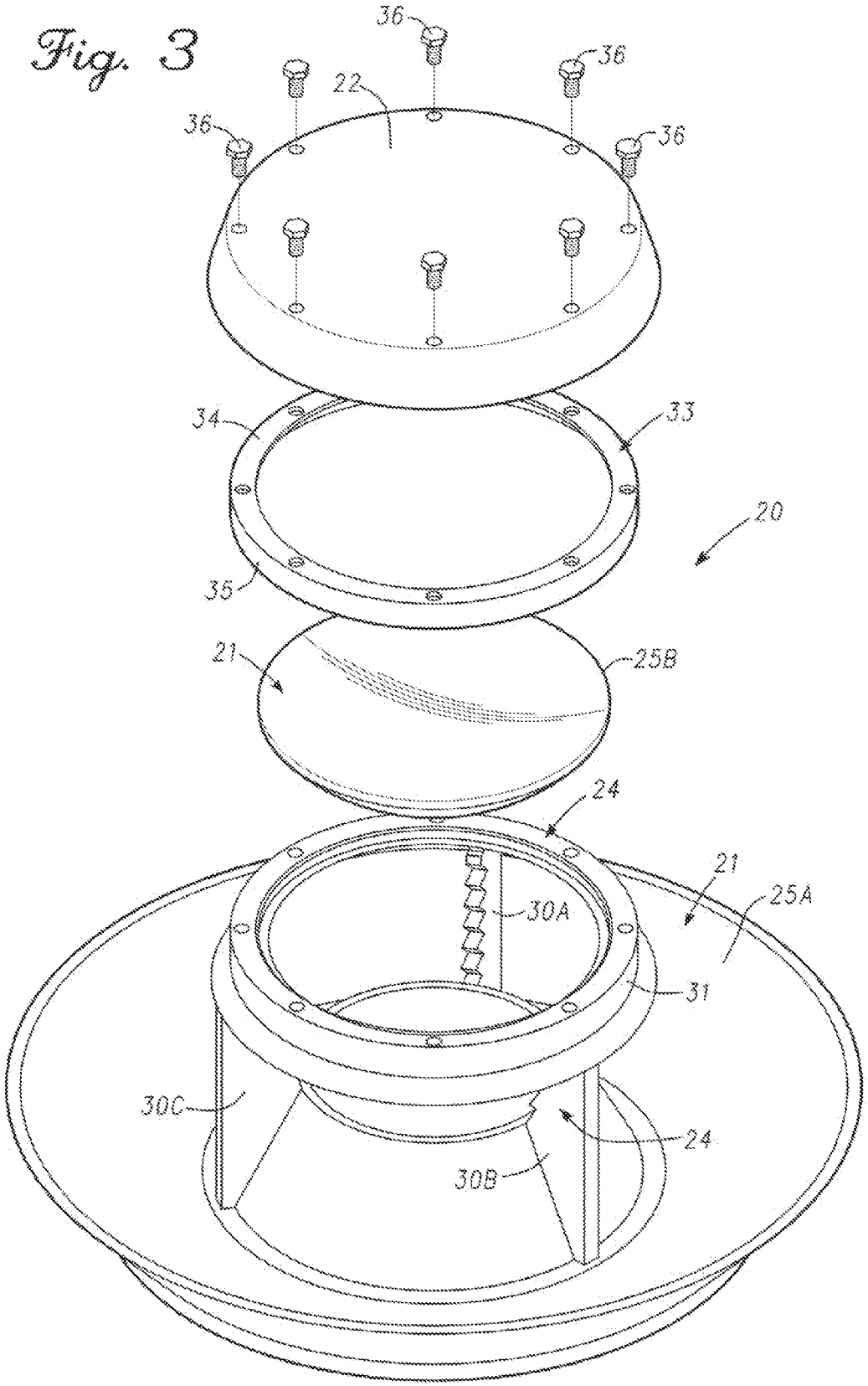
FIG. 3 is an exploded perspective view of the example optical assembly shown in FIG. 2.

The three braces 30A, 30B, 30C are joined with a support 31 that surrounds the second mirror 25B (see FIGS. 3 and 5). The support 31 and the flexures 27 are adapted to axially restrain the second mirror 25B. In the illustrated example embodiment, the support 31 also serves to radially restrain the second mirror 25B (or some other form of optic in other embodiments).

The size and shape of the support 31 will depend in part on the size and shape of the energy collection system 21 (i.e., the size and shape of second mirror 25B in the illustrated example embodiments). In addition, the support 31 may be designed to reduce the amount of stray energy ES that the second mirror 25B receives from the first mirror 25A.

Embodiments are contemplated where the structure 24 is configured to (i) axially support the energy collection system 21; (ii) radially support the energy collection system 21; or (iii) axially and radially support the energy collection system 21. The type of support provide by the structure 24 will depend in part on the overall shape of the energy collection system 21 as well as the as the need to prevent stray energy ES from entering the sensor 23 (among other factors).

In some embodiments, the optical assembly 20 further includes a shim 33 that is positioned between the structure 24 and the heat shield 22 (see FIGS. 4-6). In the illustrated example embodiments, the shim 33 includes a ring 34 that engages an upper surface of the support 31. The shim 33 may also include a flange 35 that engages an outer surface of the support 31.

The overall size and shape of the shim 33 will depend in part on the size and shape of the support 31 as well as the overall size and shape of the heat shield 22. The shim 33 may provide additional thermal isolation to the energy collection system 21.

The projectile further includes a guidance system 14 that receives data from the sensor 23 to direct the propulsion system 12. The type of guidance system 14 that is included in the projectile 10 will depend in part on the type of optical assembly 20 that is included in the projectile 10.

The type and accuracy of any data that is received from the sensor 23 will determine in part the type of guidance system 14 that is required for the projectile 10. In addition, the difficulty that is associated with acquiring any potential targets for the projectile 10 will determine the type of guidance system 14 that is required for the projectile 10 (i.e., some targets are much more difficult to acquire than other targets).

It should be noted that the difficulty that is associated with acquiring any potential targets for the projectile 10 will also determine in part the accuracy and performance that is required of the optical assembly 20. Using the heat shield 22 to control the amount of undesirable stray energy ES that would otherwise be directed to the sensor 23 may improve the ability to acquire and/or track the target.

Other embodiments relate to the optical assembly 20 where the optical assembly 20 is adapted to be used in conjunction with other devices besides a projectile. As examples, the optical assembly 20 may be part of an astronomical telescope or a tracking system.

The optical assembly 20 would similarly include an energy collection system 21 that collects energy E and a heat shield 22 that axially restrains the energy collection system 21. The optical assembly 20 would also similarly include a sensor 23 and a structure 24 which supports the energy collection system 21 such that the energy collection system 21 directs the energy E to the sensor 23.

The heat shield 22 may also similarly be configured to provide a barrier that prevents stray energy ES from reaching the sensor 23. In addition, the heat shield 22 may include flexures 27 that axially restrain the energy collection system 21.

It should be noted that the heat shield 22 may be secured to the structure 24 using fasteners 36. When the optical assembly 20 includes a shim 33 that is similar to the shim 33 shown in FIGS. 4-6, the fasteners 36 may extend through the shim 33 into the structure 24.

Embodiments are contemplated where the heat shield 22 is secured to the structure 24 in a manner that does not include fasteners 36. As an example, the heat shield 22 may be secured to the structure 24 using an adhesive. In addition, the heat shield 22 and the structure 24 may be configured such that the heat shield 22 is snap-fit onto the structure 24.

Figure 7:
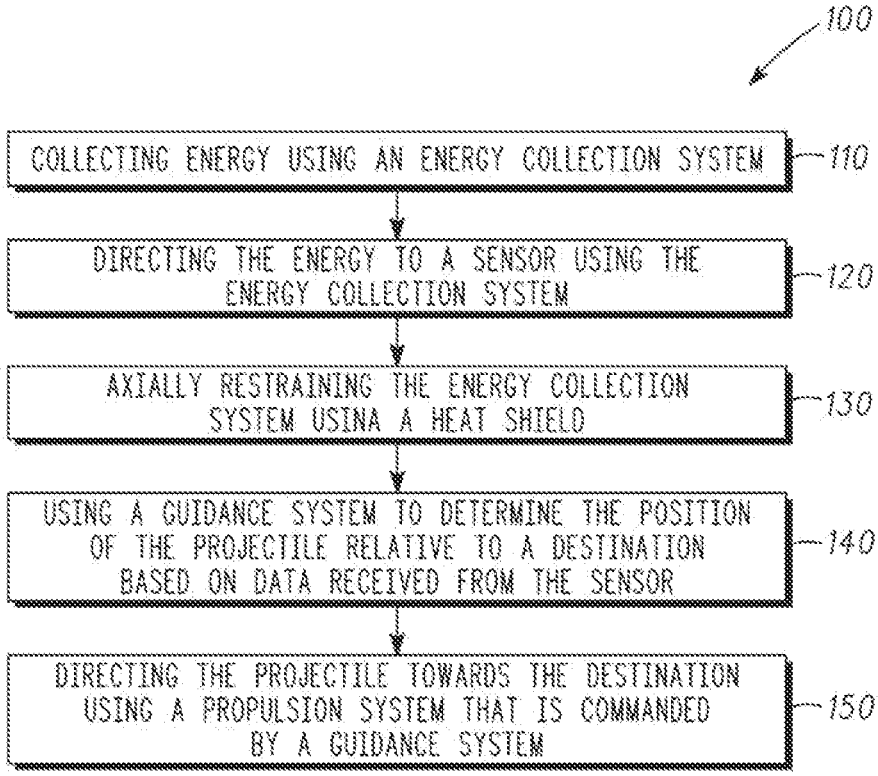
FIG. 7 is a flowchart illustrating an example method of directing a projectile.

As shown in FIG. 7, still other embodiments relate to a method 100 of directing a projectile 10. As shown in box 110, the method includes collecting energy E using an energy collection system 21. As shown in box 120, the method includes directing the energy E to a sensor 23 using the energy collection system 21.

In some embodiments, collecting energy E using an energy collection system 21 includes collecting visible light using the energy collection system 21. The type and amount of energy E that is collected by the energy collection system 21 will depend in part on the nature of the application where the projectile 10 is to be used.

As shown in box 130, the method 100 further includes axially restraining the energy collection system 21 using a heat shield 22. It should be noted that axially restraining the energy collection system 21 using a heat shield 22 may further include radially restraining the energy collection system 21 using the heat shield 22.

In some embodiments, axially restraining the energy collection system 21 using a heat shield 22 may include using flexures 27 on the heat shield 22 to axially restrain the energy collection system 21. The type of flexure 27 that is used to restrain the energy collection system 21 will depend in part on the overall size and shape of the energy collection system 21 and the rest of heat shield 22 (among other factors).

In addition, axially restraining the energy collection system 21 may include using the heat shield 22 to provide a barrier that prevents stray energy ES from reaching the sensor 23. The overall size and shape of the heat shield 22 that is required to provide a barrier that prevents stray energy ES from reaching the sensor 23 will depend in part on how the energy collection system 21 collects energy E and then directs the energy E to the sensor 23.

Embodiments for the method 100 are contemplated where axially restraining the energy collection system 21 using a heat shield 22 includes positioning a shim 33 between the heat shield 22 and a support structure 24 that restrains the energy collection system 21. In some embodiments, positioning a shim 33 between the heat shield 22 and a support structure 24 that restrains the energy collection system 21 includes (i) positioning the shim 33 around the structure 24; or (ii) positioning a plurality of shims (not shown in FIGS.) at equal intervals around the support structure 24.

As shown in box 140, the method 100 further includes using a guidance system 24 to determine the position of the projectile 10 relative to a destination based on data received from the sensor 23. As shown in box 150, the method 100 further includes directing the projectile 10 toward the destination using a propulsion system 12 that is commanded by a guidance system 14.

In some embodiments, collecting energy E using an energy collection system 21 includes collecting energy E using a first mirror 25A that directs the energy E toward a second mirror 25B. Therefore, directing the energy E to a sensor 23 using the energy collection system 21 may include using the second mirror 25B to receive the energy E from the first mirror 25A and to direct the energy E to the sensor 23.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, the embodiments may lie in less than all features of a single disclosed embodiment. Thus the following claims are hereby incorporated into the detailed description, with each claim standing on its own as a separate embodiment.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the illustrated and described embodiments. In general, structures and functionality presented as separate components in the exemplary configurations may be implemented as a combined structure or component. Similarly, structures and functionality presented as a single component may be implemented as separate components. These and other variations, modifications, additions, and improvements fall within the scope of illustrated and described embodiments.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An optical assembly comprising:

an energy collection system that collects energy;

a sensor;

a structure that supports the energy collection system such that the energy collection system directs the energy to the sensor; and a heat shield that axially restrains the energy collection system, wherein the energy collection system includes a first mirror that directs energy and a second mirror that receives the energy from the first mirror and further directs the energy to the sensor.

2. The optical assembly of claim 1, wherein the energy collection system collects visible light.

3. The optical assembly of claim 1, wherein the heat shield is configured to provide a barrier that prevents stray energy from reaching the sensor.

4. The optical assembly of claim 1, wherein the heat shield is configured to radially restrain the energy collection system.

5. The optical assembly of claim 1, wherein the structure is configured to axially and radially support the energy collection system.

6. The optical assembly of claim 1, wherein the heat shield is secured to the structure using fasteners.

7. An optical assembly comprising:

an energy collection system that collects energy;

a sensor;

a structure that supports the energy collection system such that the energy collection system directs the energy to the sensor; and a heat shield that axially restrains the energy collection system, wherein the heat shield includes flexures that axially restrain the energy collection system.

8. The optical assembly of claim 7, wherein the heat shield surrounds the structure and the flexures are positioned at equal intervals around the heat shield.

9. An optical assembly comprising:

an energy collection system that collects energy;

a sensor;

a structure that supports the energy collection system such that the energy collection system directs the energy to the sensor;

a heat shield that axially restrains the energy collection system; and a shim positioned between the structure and the heat shield.

10. The optical assembly of claim 9, wherein the shim includes a ring that surrounds the structure.

11. A projectile comprising:

a propulsion system;

an optical assembly that includes an energy collection system that collects energy, the optical assembly further including a sensor and a structure that supports the energy collection system such that the energy collection system directs the energy to the sensor, the optical assembly further including a heat shield that axially restrains the energy collection system; and a guidance system that receives data from the sensor to direct the propulsion system.

12. The projectile of claim 11, wherein the heat shield is configured to provide a barrier that prevents stray energy from reaching the sensor.

13. The projectile of claim 11, wherein the heat shield includes flexures that axially restrain the energy collection system.

14. The projectile of claim 13, wherein the heat shield surrounds the structure and the flexures are positioned at equal intervals around the heat shield.

15. The projectile of claim 11, further comprising a shim positioned between the support and the heat shield.

16. The projectile of claim 15, wherein the shim includes a ring that surrounds the structure.

17. The projectile of claim 11, wherein the structure is configured to axially and radially support the energy collection system.

18. A method of directing a projectile, the method comprising:

collecting energy using an energy collection system;

directing the energy to a sensor using the energy collection system;

axially restraining the energy collection system using a heat shield;

using a guidance system to determine a position of the projectile relative to a destination based on data received from the sensor; and directing the projectile toward the destination using a propulsion system that is commanded by a guidance system.

19. The method of claim 18, wherein collecting energy using an energy collection system includes collecting visible light using the energy collection system.

20. The method of claim 18, wherein collecting energy using an energy collection system includes collecting energy using a first mirror that directs the energy toward a second mirror, and wherein directing the energy to a sensor using the energy collection system includes using the second mirror to receive the energy from the first mirror and direct the energy to the sensor.

21. The method of claim 18, wherein axially restraining the energy collection system includes using the heat shield provide to a barrier that prevents stray energy from reaching the sensor.

22. The method of claim 18, wherein axially restraining the energy collection system using a heat shield further includes radially restraining the energy collection system using the heat shield.

23. The method of claim 18, wherein axially restraining the energy collection system using a heat shield includes using flexures on the heat shield to axially restrain the energy collection system.

24. The method of claim 18, wherein axially restraining the energy collection system using a heat shield includes positioning a shim between the heat shield and a support structure that restrains the energy collection system.

25. The method of claim 24, wherein positioning a shim between the heat shield and a support structure that restrains the energy collection system includes positioning the shim around the support structure.

26. The method of claim 24, wherein positioning a shim between the heat shield and a support structure that restrains the energy collection system includes positioning a plurality of shims at equal intervals around the support structure.

27. The method of claim 18, wherein axially restraining the energy collection system using a heat shield includes securing the heat shield using fasteners to a support structure that restrains the energy collection system.

* * * * *